US007624806B2

(12) United States Patent
Booth

(10) Patent No.: US 7,624,806 B2
(45) Date of Patent: Dec. 1, 2009

(54) PIPE CLEANING TOOL AND METHOD

(75) Inventor: Richard Keith Booth, Laxey (GB)

(73) Assignee: Hamdeen Incorporated Limited (GB)

( * ) Notice: Subject to any disclaimer, the term of this patent is extended or adjusted under 35 U.S.C. 154(b) by 134 days.

(21) Appl. No.: 11/391,117

(22) Filed: Mar. 28, 2006

(65) Prior Publication Data

US 2006/0219410 A1 Oct. 5, 2006

(30) Foreign Application Priority Data

Apr. 5, 2005 (GB) ..... 0506857.2

(51) Int. Cl.
*E21B 37/04* (2006.01)

(52) U.S. Cl. ..... 166/311; 166/386; 166/387; 166/173; 166/177.3; 15/3.5; 15/104.061

(58) Field of Classification Search ..... 166/311, 166/386, 387, 177.3, 173; 15/104.062, 104.063, 15/104.061, 104.05, 3.5, 3.51
See application file for complete search history.

(56) References Cited

U.S. PATENT DOCUMENTS

| | | | | |
|---|---|---|---|---|
| 2,334,788 | A * | 11/1943 | O'Leary | 175/267 |
| 3,503,445 | A | 3/1970 | Cochrum et al. | |
| 3,708,819 | A * | 1/1973 | Breston | 15/104.061 |
| 6,098,231 | A * | 8/2000 | Smith et al. | 15/104.061 |
| 6,374,838 | B1 * | 4/2002 | Baugh | 134/167 C |
| 6,944,902 | B1 * | 9/2005 | Richter et al. | 15/104.061 |
| 2002/0104649 | A1 * | 8/2002 | Allen | 166/173 |

* cited by examiner

*Primary Examiner*—Shane Bomar
*Assistant Examiner*—Robert E Fuller
(74) *Attorney, Agent, or Firm*—Drinker, Biddle & Reath LLP

(57) ABSTRACT

A method of cleaning a pipe provides a tool within the pipe. The tool has a body of smaller diameter than the pipe such that the body and pipe define an annulus and a fluid guiding member located at the annulus and movable relative to the pipe. The fluid guiding member moves relative to the pipe to guide fluid forward of the fluid guiding member to a pipe outlet.

18 Claims, 1 Drawing Sheet

PIPE CLEANING TOOL AND METHOD

FIELD OF THE INVENTION

The present invention relates to apparatus and methods for cleaning the internal surface of pipes. In particular, but not exclusively, the invention relates to a tool for, and a method of, cleaning the internal surface of riser pipes used for oil well drilling.

BACKGROUND OF THE INVENTION

Riser pipes are used to connect a well at the seabed and a floating rig. In deep water, the cold seawater temperature can cause congealing of the drilling fluid, such as mud or brine, within the riser pipe. The riser pipe typically has a diameter of around 0.5 metres or larger. Therefore, with this large flow area and a more viscous fluid, the pumping capacity is typically insufficient to achieve the turbulent flow required to displace all of the existing fluid from the pipe. Rather, fluid returning to the surface tends to channel through the colder and therefore more viscous existing fluid.

Consequently, it can take several stages, and between two and four days, depending on the depth of the seabed to displace the existing fluid. This represents a significant waste of time for the drilling operation, which is inefficient and costly.

It is desirable to provide a tool which more effectively removes existing fluid from the riser pipe.

BRIEF SUMMARY OF THE INVENTION

According to a first aspect of the present invention, there is provided a method of cleaning a pipe comprising:

providing a tool within the pipe, the tool having:

a body of smaller diameter than the pipe such that the body and pipe define an annulus;

a fluid guiding member located at the annulus and movable relative to the pipe; and moving the fluid guiding member relative to the pipe to guide fluid forward of the fluid guiding member to a pipe outlet.

Preferably the step of moving the fluid guiding member comprises pumping fluid through an internal bore of the tool such that the fluid returns via the annulus to act upon a rear portion of the fluid guiding member.

Preferably the step of moving the fluid guiding member relative to the pipe comprises extracting the tool from the pipe. Alternatively, the step of moving the fluid guiding member relative to the pipe may comprise moving the fluid guiding member relative to the tool.

Preferably the steps of pumping the fluid through the internal bore and extracting the tool from the pipe are performed simultaneously. Preferably the rate of pumping the fluid through the internal bore substantially corresponds to the rate of extracting the tool from the pipe. A rate of pumping and a rate of tool extraction are selected such that the pumped fluid displaces the fluid guiding member at a rate substantially equal to the rate at which the tool is extracted from the pipe.

Preferably the fluid guiding member has valve means for selectively permitting or preventing the flow of fluid in the annulus past the fluid guiding member. Preferably the valve means is adapted to release pressure of the fluid acting upon the rear portion of the fluid guiding member.

Preferably the tool body includes a fluid bypass channel and the fluid guiding member comprises a sleeve movable relative to the bypass channel between a first position and a second position. Preferably the bypass channel is closed when the sleeve is at the first position. Preferably the bypass channel is open when the sleeve is at the second position. Preferably the bypass channel is open when the sleeve is at an intermediary position. The bypass channel and sleeve thus provide the valve means. The flow of fluid within the bypass channel provides the release of pressure of the fluid acting upon the rear portion of the fluid guiding member.

Preferably the sleeve is provided with friction means which cooperates with the internal surface of the pipe for moving the sleeve. Preferably the friction means comprises one or more wipers and the method includes wiping the internal surface of the pipe as the sleeve is moved relative to the pipe.

According to a second aspect of the present invention, there is provided a pipe cleaning tool comprising:

a body of smaller diameter than the pipe such that the body and pipe define an annulus; and a fluid guiding member located at the annulus and movable relative to the pipe to guide fluid forward of the fluid guiding member to a pipe outlet.

Preferably the tool includes an internal bore such that fluid may be pumped through the internal bore and return via the annulus to act upon a rear portion of the fluid guiding member.

Preferably the tool is connectable to a drill string such that the tool is extractable from the pipe. Preferably the tool is connectable within a drill string such that the tool forms an intermediate portion of the drill string. Alternatively, the tool may be connectable to an end portion of a drill string.

Preferably the tool includes pumping rate determining means for determining the pumping rate of the fluid through the internal bore. Preferably the tool includes extraction rate determining means for determining the rate of extracting the tool from the pipe. Preferably the pumping rate determining means and the extraction rate determining means are selectable such that they substantially correspond.

Preferably the fluid guiding member includes valve means for selectively permitting or preventing the flow of fluid in the annulus past the fluid guiding member. Preferably the valve means is adapted to release pressure of the fluid acting upon the rear portion of the fluid guiding member.

Preferably the tool body includes a fluid bypass channel and the fluid guiding member comprises a sleeve movable relative to the bypass channel between a first position and a second position. Preferably the bypass channel is closed when the sleeve is at the first position. Preferably the bypass channel is open when the sleeve is at the second position. Preferably the bypass channel is open when the sleeve is at an intermediary position. The bypass channel and sleeve thus provide the valve means.

Preferably the sleeve is provided with friction means which cooperates with the internal surface of the pipe for moving the sleeve. Preferably the friction means comprises one or more wipers for wiping the internal surface of the pipe as the sleeve is moved relative to the pipe.

BRIEF DESCRIPTION OF THE DRAWINGS

An embodiment of the present invention will now be described, by way of example only, with reference to the accompanying drawings, in which.

DETAILED DESCRIPTION OF THE DISCLOSED EMBODIMENT

Figure 1:
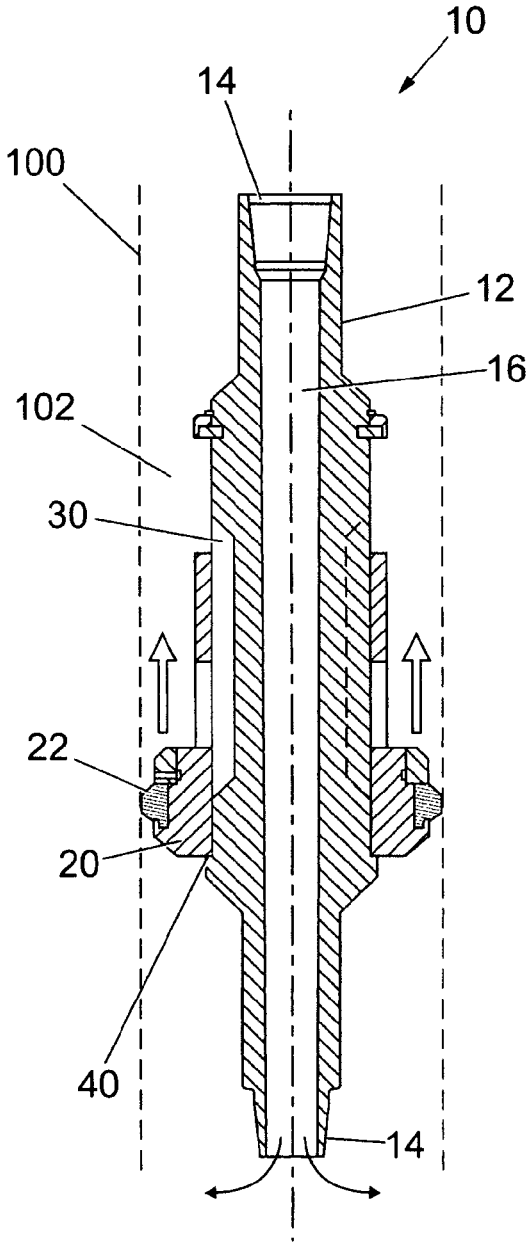
FIG. 1 is a longitudinal sectional view of the tool within a pipe with the fluid guiding member at a first position.
Figure 2:
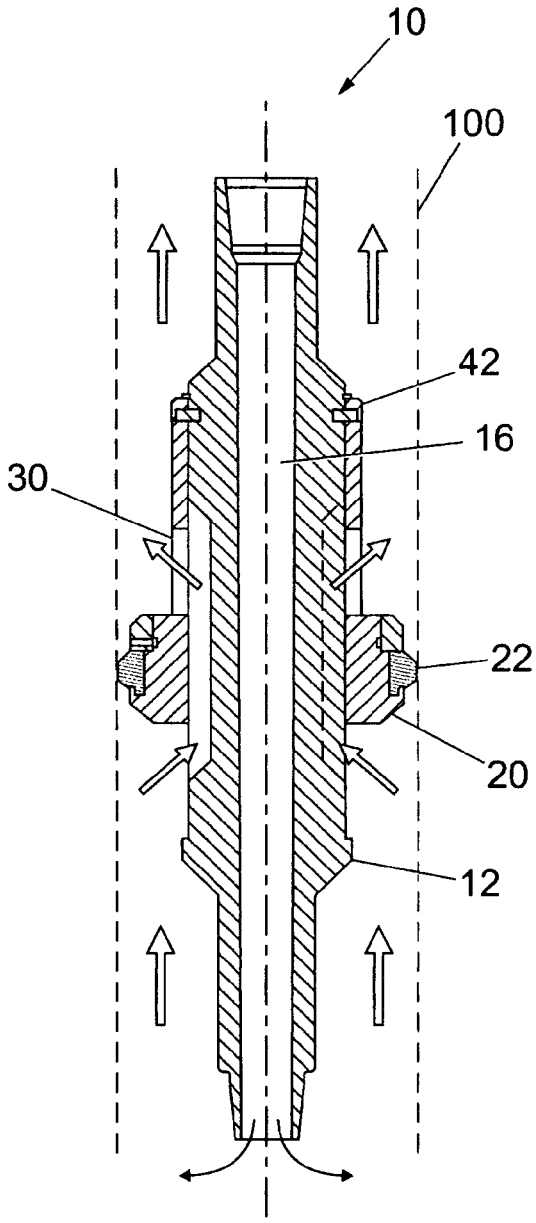
FIG. 2 is a longitudinal sectional view of the tool of FIG. 1 with the fluid guiding member at a second position.

FIG. 1 shows a pipe cleaning tool 10 located within a riser pipe 100. The tool 10 has a body 12 which is smaller in its outer diameter to the internal diameter of the pipe 100. The body and pipe define an annulus 102. A fluid guiding member 20 is provided in the form of a sleeve which is axially slidable relative to the tool body 12 between a first position as shown in FIG. 1 and a second position as shown in FIG. 2.

The sleeve 20 is prevented from travelling beyond the first position by a stop 40. The sleeve 20 extends in the annulus 102 from the tool body 12 to the internal surface of the riser pipe 100 thus forming a barrier between the fluid above and below the sleeve 20. Friction means in the form of a wiper 22 is provided at the outer periphery of the sleeve 20 and in contact with the internal surface of the riser pipe 100. The wiper 22 cleans the internal surface of the riser pipe 100 when the sleeve 20 moves relative to the pipe 100. The wiper 22 also cooperates with the internal surface of the pipe 100 for moving the sleeve 20 relative to the tool body 12. The wiper 22 also provides a sealing action, although hermetic sealing is not necessary.

The tool 10 includes connecting portions 14 for connecting the tool 10 within a drill string. Rotation and axial movement of the tool is therefore possible using the top drive which controls the drill string. It is to be appreciated that the tool 10 may be connected to an end of the drill string.

The tool body 12 includes a number of fluid bypass channels 30. When the sleeve 20 is in the first position as shown in FIG. 1, fluid is unable to pass the sleeve 20 in the annulus 102 and the bypass channels 30 are closed.

FIG. 2 shows the tool with the sleeve 20 at a second position. The sleeve 20 is prevented from travelling beyond the second position by a second stop 42. In this position, the bypass channels 30 are open and fluid can flow past the sleeve 20 in the bypass channels 30 between the sleeve 20 and body 12.

In use, the tool is run into the pipe 100 and the hydraulic action of the fluid in the pipe 100 acting upon the sleeve 20 and frictional contact between the wiper 22 and internal surface of the pipe 100 cause the sleeve 20 to travel to the second position as shown in FIG. 2. In this position, it is possible for the tool 10 to be operated in a conventional manner with fluid being pumped down the internal bore 16 and returning via the annulus 102.

During run in, the wipers 22 wipe the internal surface of the riser pipe 100 to dislodge congealed matter. This can be repeated a number of times for better cleaning of the internal surface of the pipe 100.

For effective cleaning of the pipe 100, the tool 10 can be extracted from the pipe while fluid is being pumped down the internal bore 16. Extraction of the tool 10 and frictional contact of the wiper 22 and internal surface of the pipe 100 cause the sleeve 22 to move to the first position as shown in FIG. 1. In this position, the bypass channels 30 are closed and the fluid pumped down the internal bore 16 and returning in the annulus 102 acts upon a rear portion of the sleeve 20.

The rate of pumping and the rate of extracting the tool are coordinated such that the sleeve 20 moves upwards relative to the pipe 100 at substantially the same rate as the tool 10 is extracted. Thus, virtually all of the fluid above the sleeve 20 is forced upwards to the pipe outlet. Therefore, the pump fluid does not tend to channel through the existing fluid but rather provides the actuating force for movement of the sleeve 20 which displaces the existing fluid.

The sleeve 20 may also be considered to be a barrier between the pumped fluid and the existing fluid, and so prevents the pumped fluid from channeling through the existing fluid.

If the rate of pumping and the rate of extracting the tool are not substantially coordinated such that the rate of extracting is greater then this will have minimal effect as the sleeve 20 will simply remain in the first position against the stop 40. If the rate of pumping and the rate of extracting the tool are not substantially coordinated such that the rate of pumping, and hence the rate of displacing the sleeve 20, is greater then this will tend to cause the sleeve 20 to move upwards from the first position. However, upwards movement of the sleeve will cause the bypass channels 30 to open, thus allowing a portion of fluid to flow past the sleeve 20. This results in the release of fluid pressure below the sleeve until the rate of pumping and the rate of extracting the tool are again balanced.

Various modifications and improvements can be made without departing from the scope of the present invention.

The invention claimed is:

1. A method of cleaning a pipe comprising:

inserting a tool through a pipe outlet of the pipe, the pipe having an internal diameter, the tool having:

a body having an external diameter which is less than the internal diameter of the pipe such that the body and the pipe define an annulus; and a valve comprising a fluid guiding member located at the annulus and movable relative to the body for selectively permitting or preventing the flow of fluid in the annulus past the tool;

moving the fluid guiding member relative to the body to close the valve to prevent the flow of fluid in the annulus past the tool; and moving the tool relative to the pipe to guide virtually all of the fluid which is forward of the fluid guiding member to the pipe outlet and to clean the pipe.

2. The method as claimed in claim 1, wherein the tool includes an internal bore, and wherein the fluid guiding member includes a rear portion, and wherein the step of moving the fluid guiding member comprises pumping fluid through the internal bore such that the fluid returns via the annulus to act upon the rear portion of the fluid guiding member.

3. The method as claimed in claim 2, wherein the step of moving the fluid guiding member relative to the body comprises extracting the tool from the pipe.

4. The method as claimed in claim 3, wherein the steps of pumping the fluid through the internal bore and extracting the tool from the pipe are performed simultaneously.

5. The method as claimed in claim 4, wherein the rate of pumping the fluid through the internal bore substantially corresponds to the rate of extracting the tool from the pipe.

6. The method as claimed in claim 1, wherein the valve is adapted to release pressure of the fluid acting upon the rear portion of the fluid guiding member.

7. The method as claimed in claim 1, wherein the valve includes a fluid bypass channel in the body and the fluid guiding member comprises a sleeve movable relative to the bypass channel between a first position and a second position.

8. The method as claimed in claim 7, wherein the bypass channel is closed when the sleeve is at the first position.

9. The method as claimed in claim 7, wherein the bypass channel is open when the sleeve is at the second position.

10. The method as claimed in claim 7, wherein the bypass channel is open when the sleeve is at an intermediary position.

11. The method as claimed in claim 7, wherein the pipe has an internal surface, and wherein the sleeve is provided with friction means which cooperates with the internal surface for moving the sleeve relative to the bypass channel.

12. The method as claimed in claim 11, wherein the friction means comprises at least one wiper, and the method includes moving the tool relative to the pipe and wiping the internal surface of the pipe with the wiper as the tool is moved relative to the pipe.

13. A tool for cleaning a pipe, the pipe having an internal diameter and a pipe outlet, the tool comprising:

a body having an external diameter which is less than the internal diameter of the pipe such that the body and pipe define an annulus;

a valve comprising a fluid guiding member located at the annulus and movable relative to the pipe to guide virtually all of the fluid which is forward of the fluid guiding member to the pipe outlet;

the valve further comprising a fluid bypass channel, the valve selectively permitting or preventing the flow of fluid in the annulus past the tool;

wherein the valve prevents the flow of fluid in the annulus past the tool when the valve is closed and when the fluid which is forward of the fluid guiding member is guided to the pipe outlet; and wherein the fluid guiding member comprises a sleeve movable relative to the bypass channel between a first position and a second position.

14. The tool as claimed in claim 13, wherein the bypass channel is closed when the sleeve is at the first position and open when the sleeve is at the second position.

15. The tool as claimed in claim 13, wherein the bypass channel is open when the sleeve is at an intermediary position.

16. A method of cleaning a pipe comprising:

providing a tool within the pipe, the pipe having an internal diameter and a pipe outlet, the tool having:

a body having an external diameter which is less than the internal diameter of the pipe such that the body and the pipe define an annulus; and a fluid guiding member located at the annulus and movable relative to the pipe; and moving the fluid guiding member relative to the pipe to guide virtually all of the fluid which is forward of the fluid guiding member to the pipe outlet;

wherein the tool includes an internal bore, and wherein the fluid guiding member includes a rear portion;

wherein moving the fluid guiding member relative to the pipe comprises pumping fluid through the internal bore such that the fluid returns via the annulus to act upon the rear portion of the fluid guiding member; and wherein moving the fluid guiding member relative to the pipe comprises extracting the tool from the pipe.

17. The method as claimed in claim 16, wherein the steps of pumping the fluid through the internal bore and extracting the tool from the pipe are performed simultaneously.

18. The method as claimed in claim 17, wherein the rate of pumping the fluid through the internal bore substantially corresponds to the rate of extracting the tool from the pipe.

* * * * *